US011772114B2

(12) United States Patent
Zhu

(10) Patent No.: US 11,772,114 B2
(45) Date of Patent: Oct. 3, 2023

(54) ALL-PLASTIC EMULSION PUMP

(71) Applicant: Jingyuan Pan, Guangdong (CN)

(72) Inventor: Guangwei Zhu, Zhongshan (CN)

(73) Assignee: Jingyuan Pan, Guangdong (CN)

( * ) Notice: Subject to any disclaimer, the term of this patent is extended or adjusted under 35 U.S.C. 154(b) by 27 days.

(21) Appl. No.: 17/640,277

(22) PCT Filed: Jan. 14, 2021

(86) PCT No.: PCT/CN2021/071646
§ 371 (c)(1),
(2) Date: Mar. 3, 2022

(87) PCT Pub. No.: WO2021/169649
PCT Pub. Date: Sep. 2, 2021

(65) Prior Publication Data

US 2022/0339653 A1 Oct. 27, 2022

(30) Foreign Application Priority Data

Feb. 25, 2020 (CN) ..... 202010114149.8

(51) Int. Cl.
*B05B 11/00* (2023.01)
*B05B 11/10* (2023.01)

(52) U.S. Cl.
CPC ..... *B05B 11/1077* (2023.01); *B05B 11/1043* (2023.01); *B05B 11/1071* (2023.01)

(58) Field of Classification Search
CPC ..... B05B 11/1077; B05B 11/1043; B05B 11/1071; B05B 11/1047; B05B 11/106;
(Continued)

(56) References Cited

U.S. PATENT DOCUMENTS 5,351,862 A 10/1994 Weag
5,664,703 A * 9/1997 Reifenberger ..... B05B 11/1067 222/207

(Continued)

FOREIGN PATENT DOCUMENTS

CN 201099466 Y 8/2008
CN 201880641 U 6/2011

(Continued)

OTHER PUBLICATIONS

Apr. 1, 2021 International Search Report issued in International Application No. PCT/CN2021/071646.

(Continued)

*Primary Examiner* — Vishal Pancholi
(74) *Attorney, Agent, or Firm* — WELSH FLAXMAN & GITLER LLC

(57) ABSTRACT

An all-plastic emulsion pump, includes a body, threads, pressing head, main column, suction tube, plastic spring, pull rod, stopper, lock cover, first and second one-way valve devices made of plastic material. A communication port is between the plastic spring and the main column. The pull rod is in the plastic spring. The stopper is connected to the pull rod upper end. When the plastic spring is pressed, there is a gap between the pull rod and the side wall of the communication port. When the plastic spring pops up, the stopper blocks the communication port. The first one-way valve device is between the pressing head and the main column to supply the emulsion to the pressing head. The second one-way valve device is between the plastic spring and the inlet of the body to supply the emulsion from the inlet of the body into the plastic spring.

9 Claims, 5 Drawing Sheets

(58) Field of Classification Search
CPC ..... B05B 11/1069; B05B 11/1053; B05B 11/0075; B05B 11/10; B05B 11/1073
See application file for complete search history.

(56) References Cited

U.S. PATENT DOCUMENTS

| | | | | |
|---|---|---|---|---|
| 6,536,630 | B1 | 3/2003 | Chan et al. | |
| 7,111,761 | B2 * | 9/2006 | Masuda | B05B 11/0029 222/387 |
| 10,010,897 | B2 * | 7/2018 | Espinoza | B05B 11/106 |
| 10,543,500 | B2 * | 1/2020 | Nilsson | B05B 11/1029 |
| 2005/0072807 | A1 * | 4/2005 | Hsiao | G01F 11/028 222/251 |
| 2015/0136810 | A1 * | 5/2015 | Ding | B05B 11/1074 222/321.9 |

FOREIGN PATENT DOCUMENTS

| | | | |
|---|---|---|---|
| CN | 201932521 | U | 8/2011 |
| CN | 106428966 | A | 2/2017 |
| CN | 11186631 | A | 5/2020 |
| CN | 211663801 | U | 10/2020 |
| JP | h07242258 | A | 9/1995 |
| JP | H10101115 | A | 4/1998 |
| JP | 2004261639 | A | 9/2004 |
| JP | 2005029191 | A | 2/2005 |
| JP | 2008284410 | A | 11/2008 |
| JP | 2010105724 | A | 5/2010 |
| JP | 2011063289 | A | 3/2011 |
| JP | 2012507452 | A | 3/2012 |
| JP | 2014525877 | A | 10/2014 |

OTHER PUBLICATIONS

Apr. 1, 2021 Written Opinion issued in International Application No. PCT/CN2021/071646.
Request for the Submission of an Opinion dated 12/06/20214 (Korean patent Office).
Notice of Reasons for Refusal Application No. Japanese Patent Application No. 2021-576924 dated Mar. 20, 2023 Japanese Patent Office.
Russian Federation Office Action dated Apr. 7, 2023.
Canadian Patent Office Search Report dated Feb. 22, 202.
Australia Search Report dated Jun. 1, 2023.

* cited by examiner

ALL-PLASTIC EMULSION PUMP

TECHNICAL FIELD

The invention relates to an all-plastic emulsion pump.

BACKGROUND ART

At present, the emulsion pumps on the market are mainly composed of a pressing head (or an elbow), a lock cover, a metal spring, a thread cover, a body, a main column, a piston, an auxiliary column, and a glass ball, such as emulsion pump recorded in the patent No. 201020679937.3 published in Chinese patent documentation. According to the patent, the emulsion pump comprises a pressing head, a lock cover, a gasket, a spring, a thread cover, a body, a main column, a piston, an auxiliary column, a glass ball, and a suction tube, wherein an inner cylinder in the middle of the pressing head is connected with the upper part of the main column; an outer cylinder in the middle of the pressing head is annularly sleeved on a cylinder at the upper part of the thread cover; the thread cover is connected with the lock cover; the inner wall of the thread cover is provided with threads matched with a bottle opening; two ends of the spring respectively butt against the main column and the lock cover; the spring is arranged on an annular cylindrical cavity outside the wall of the main column. Because of the metal spring contained in the emulsion pump with the structure, it is difficult to meet the environmental control standards for foreign markets, especially for European and American markets. While one emulsion pump contains plastic, metal, and glass parts at the same time, it needs to be disassembled and classified for recovery, which is not conducive to product recovery. In addition, a piston is used, and the inner cavity of the body serves as a pump cavity for the piston to move up and down. The emulsion enters the inner cavity of the body from the suction tube through the glass ball, and enters the main column through the piston and the auxiliary column, and flows out from the pressing head. In the initial state, it is necessary to inject a small amount of lubricating fluid that does not conflict with the properties of the emulsion to lubricate the piston, so that the piston can move smoothly in the inner cavity of the body at the beginning of the use.

The invention is made based on this situation.

SUMMARY OF THE INVENTION

The technical problem to be solved by the invention is to provide an all-plastic emulsion pump, wherein all parts of the emulsion pump are made of plastic material, which is easy to meet high environmental requirements, easy to recycle, and no need to use lubricating liquid.

In order to solve the above technical problems, an all-plastic emulsion pump of the invention comprises a body and a pressing head, wherein an upper end of the body is provided with threads, a lower end of the body is provided with a suction tube communicated with an inlet of the lower end of the body, the pressing head is connected to a main column inserted into the body, a plastic spring which can jack up the pressing head and the main column is provided in an inner cavity of the body, the plastic spring is located below the main column, the plastic spring is in a sealed connection with the main column, the plastic spring is a plastic spring tube with upper and lower ends open and side sealed, the upper end of the plastic spring is in communication with the main column, and the lower end of the plastic spring is in communication with the inlet of the body so that the plastic spring forms a channel for connecting the main column with the inlet of the body and for liquid to flow; at least a communication port for communicating the plastic spring and the main column up and down is provided between the two, the body is provided with a pull rod located inside the plastic spring, the pull rod corresponds up and down with the communication port and can penetrate out of the communication port when the plastic spring is pressed down, and there is a gap between the pull rod and side wall of the communication port; an upper end of the pull rod is provided with a stopper located above the communication port, and the stopper can press on the communication port from above when the plastic spring is pop-up to pull down the plastic spring and the main column, and seal the communication port; an upper opening of the body is provided with a lock cover which can limit the plastic spring in the body; a first one-way valve device is provided between the pressing head and the main column, which can allow emulsion in the main column to flow to the pressing head and prevent emulsion in the pressing head from flowing to the main column; a second one-way valve device is provided between the plastic spring and the inlet of the body, which can allow emulsion to flow into the plastic spring from the inlet of the body and prevent the emulsion in the plastic spring from flowing out of the inlet of the body; the body, the threads, the pressing head, the main column, the suction tube, the plastic spring, the pull rod, the stopper, the lock cover, the first one-way valve device, and the second one-way valve device are respectively made of plastic material.

In the all-plastic emulsion pump, the lock cover is sleeved on the outer side of the main column, and a waterproof sleeve is provided between the lock cover and the main column for blocking a gap between an upper end of the lock cover and the main column.

In the all-plastic emulsion pump, the plastic spring and the main column are snap-connected and can prevent the two from being separated up and down.

In the all-plastic emulsion pump, the upper end of the plastic spring is provided with an annular fastening portion inserted into the main column from a lower port of the main column, an outer side surface of the fastening portion is in a sealing connection with an inner side surface of the main column, and the communication port is provided on the plastic spring and is located inside the fastening portion; a second buckling ring protrudes from an outer side of the fastening portion, and an inner wall of the main column is provided with a second buckling groove which is recessed and buckled with the second buckling ring.

In the all-plastic emulsion pump, the upper end of the plastic spring is provided with an annular end surface which is positioned outside the fastening portion and can be fit to the lower end face of the main column hermetically; when the main column is pressed down, the lower end face of the main column presses against the annular end surface and forms a seal between the two end faces.

In the all-plastic emulsion pump, inner holes of the lower ends of the fastening portion and the main column are circular; the second buckling ring and the second buckling groove are correspondingly annular, and enable the main column to rotate relative to the plastic spring under the action of an external force; a guide structure for guiding an up and down movement of the main column is arranged between the lock cover and the main column, and when the main column rotates relative to the lock cover, the guide structure is misaligned and prevents the up and down movement of the main column.

In the all-plastic emulsion pump, the guide structure includes a guiding groove arranged on the lock cover, and the main column is provided with a guiding column for guiding up and down in cooperation with the guiding groove; one side of an upper end of the guiding groove is provided with a locking groove which is recessed and can be used for the guiding column to rotate out of the guiding groove and then snap in after the main column pops up, and groove bottom of the locking groove is located below the guiding column and limits the downward movement of the guiding column.

In the all-plastic emulsion pump, the first one-way valve device includes a first valve core, the main column is provided therein with a main column outlet in communication with the pressing head, the first valve core includes a first outer ring fixed between the pressing head and the main column, an inner side of the first outer ring is provided with a first inner core isolated from the first outer ring and covering the main column outlet from the side of the pressing head, and the first outer ring and the first inner core are elastically connected via a first rib and enable the first inner core to float upwards when its bottom is pressed so as to open the main column outlet.

In the all-plastic emulsion pump, a sealing seat for sealing and connecting the plastic spring and the body is provided therebetween; a lower end of the pull rod is fixed on the sealing seat, a bottom of the sealing seat is provided with a bottom cavity, the sealing seat is provided with at least a through-hole communicating the plastic spring with the bottom cavity, the bottom cavity is communicated with the inlet of the body.

In the all-plastic emulsion pump, the second one-way valve device includes a second valve core, the second valve core is located in the bottom cavity, the second valve core includes a second outer ring fixed between the sealing seat and the body, an inner side of the second outer ring is provided with a second inner core which is isolated from the second outer ring and covering the inlet of the body from one side of the bottom cavity, and the second outer ring and the second inner core are elastically connected via a second rib and enable the second inner core to float upwards when its bottom is pressed so as to open the inlet of the body.

In the all-plastic emulsion pump, the lock cover is located above the plastic spring, and when the plastic spring pops up, the lock cover stops the plastic spring from above and defines the maximum height of the plastic spring popping up, the plastic spring is in a compressed state when popping up and pressing against the lock cover; a lower end of the plastic spring presses on the sealing seat and presses the sealing seat against a bottom of the inner cavity of the body; the sealing seat is provided with a sealing groove for the lower end of the plastic spring to be inserted; the lower end face of the plastic spring presses against groove bottom of the sealing groove and is sealingly fit with the groove bottom of the sealing groove; under the elastic pressure of the plastic spring, a bottom surface of the sealing seat closely attaches with the bottom of the inner cavity of the body and forms a seal with the bottom of the inner cavity of the body at the bottom surface of the sealing seat.

Compared with the prior art, the invention has the following advantages.

1. The invention provides an all-plastic emulsion pump, each of the parts constituting the emulsion pump is made of a plastic material to better meet the environmental requirements of a high standard, and be easily recovered without disassembling and classifying the parts, and eliminates the need for pistons and piston-specific lubricants.
2. The invention adopts a completely new structure, by arranging a side-sealed tubular plastic spring under the main column, and connecting the main column and the inlet of the body via the plastic spring to form a channel for the emulsion to flow from the inlet of the body to the main column, the first one-way valve device is provided between the pressing head and the main column, and the second one-way valve device is provided between the plastic spring and the inlet of the body so that one storage cavity for storing the emulsion is formed among the main column, the plastic spring, the first one-way valve device, and the second one-way valve device. When the pressing head is pressed under the action of an external force, the plastic spring is compressed and shortened, the volume of the storage cavity becomes smaller, and the internal pressure becomes larger, forming a pressure difference with the outside; since the first one-way valve device and the second one-way valve device are both in a one-way circulating structure, the emulsion flows from the storage cavity to the pressing head via the first one-way valve device and flows out from the pressing head. When the external force is released, the main column and the pressing head are jacked up under the elastic force of the plastic spring. As the plastic spring expands and becomes longer, the volume of the storage cavity becomes larger, and the internal pressure thereof becomes smaller, forming a pressure difference with the outside. The emulsion flows, via the suction tube, into the storage cavity from the inlet of the body via the second one-way valve device so as to achieve the effect of pumping the emulsion. However, arranging a pull rod inside the plastic spring and a stopper on the upper end of the pull rod, when the plastic spring pops up, the plastic spring and the main column are pulled down by pressing the stopper on the communication port, and the communication port is blocked and sealed so that when the bottle is deformed under pressure, the emulsion in the plastic spring can be prevented from entering the main column through the communication port. Therefore, the emulsion in the main column can be prevented from flowing out after flowing to the pressing head, and the sealing property is good. The stopper has an inverted conical structure, middle and lower parts thereof can be pressed into the communication port so that the sealing property and stability are better. When the pressing head is pressed down, the communication port moves downward as the main column and the plastic spring contract, and disengages from the stopper, and the emulsion flows from the plastic spring into the main column through at least a gap between the pull rod and the side wall of the communication port.
3. In the invention, the lock cover is located above the plastic spring, and when the plastic spring pops up, and the lock cover stops the plastic spring from above and defines the maximum height of the plastic spring popping up; the plastic spring is in a compressed state when popping up and pressing on the lock cover; the lower end of the plastic spring presses on the sealing seat and presses the sealing seat on the bottom of the inner cavity of the body; the sealing seat is provided with a sealing groove for the lower end of the plastic spring to be inserted; the lower end face of the plastic spring presses on the groove bottom of the sealing groove and is sealingly fit with the groove bottom of the sealing groove; under the elastic pressure of the plastic spring, the bottom surface of the sealing seat closely attaches with the bottom of the inner cavity of the body and forms a seal with the bottom of the inner cavity of the body at the bottom surface of the sealing seat. Since the plastic spring is in different degrees of compressed state in the pop-up state, the pressed-down state, and during the pop-up and the pressed-down process, the sealing seat can always be pressed on the bottom of the inner cavity of the body, the sealing seat and the body are always connected in a sealed manner, and the lower end face of the plastic spring is always pressed on the groove bottom of the sealing groove in a sealed connection. And since the plastic spring is pressed between the lock cover and the sealing seat in the pop-up state, the friction force to be overcome for the rotation of the plastic spring and the sealing seat is large. When the pressing head and the main column are rotated, the main column can be rotated relative to the plastic spring, thereby preventing the rotation of the plastic spring and the sealing seat.

4. In the invention, the plastic spring is in a compressed state after popping up. On the one hand, it can stabilize the position of the pressing head and the main column after popping up; on the other hand after the plastic spring pops up, it can make the pull rod and the stopper pull tightly at the communication port to ensure the sealing; further, when the bottle is deformed under pressure and the pressure of the inner cavity of the plastic spring increases, the rising up pressure of the plastic spring is shared via the lock cover to prevent the pulling force of the pull rod and the stopper from being too large at the communication port.

BRIEF DESCRIPTION OF THE DRAWINGS

The specific preferred embodiments of the invention will be described in further detail below in conjunction with the drawings, in which.

DETAILED DESCRIPTION OF THE INVENTION

Figure 1:
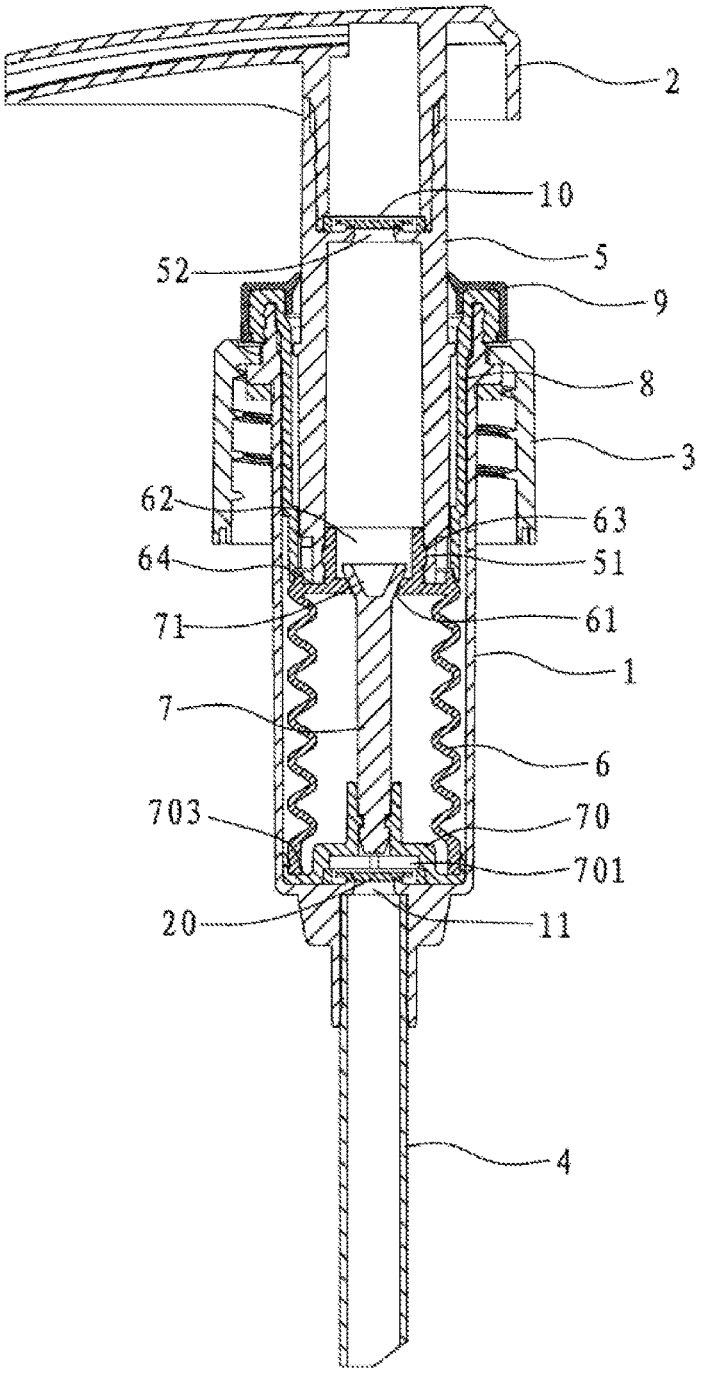
FIG. 1 is a sectional view of an all-plastic emulsion pump of the invention in a state when a pressing head thereof is pop-up.

The invention will be described in further detail below with reference to the drawings. As shown in FIGS. 1 to 8, an all-plastic emulsion pump comprises a body 1 and a pressing head 2, wherein an upper end of the body 1 is provided with threads 3 for connecting with a bottle, a lower end of the body 1 is provided with a suction tube 4 in communication with an inlet 11 of the lower end of the body 1, the pressing head 2 is connected to a main column 5 inserted into the body 1, a plastic spring 6 which can jack up the pressing head 2 and the main column 5 is provided in the inner cavity of the body 1, the plastic spring 6 is located below the main column 5, the plastic spring 6 is in a sealed connection with the main column 5, the plastic spring 6 is a plastic spring tube with upper and lower ends open and side sealed, the upper end of the plastic spring 6 is in communication with the main column 5, and the lower end of the plastic spring 6 is in communication with the inlet 11 of the body so that the plastic spring 6 forms a channel for connecting the main column 5 with the inlet 11 of the body and for liquid to flow; a communication port 61 for communicating the plastic spring 6 and the main column 5 up and down is provided between the two, the body 1 is provided with a pull rod 7 located inside the plastic spring 6, the pull rod 7 corresponds up and down with the communication port 61 and can penetrate out of the communication port 61 when the plastic spring 6 is pressed down, and there is a gap between the pull rod 7 and side wall of the communication port 61; an upper end of the pull rod 7 is provided with a stopper 71 located above the communication port 61, and the stopper 71 can press on the communication port 61 from above when the plastic spring 6 is pop-up to pull down the plastic spring 6 and the main column 5, and seal the communication port 61; an upper port of the body 1 is provided with a lock cover 8 which can limit the plastic spring 6 in the body 1; a first one-way valve device is provided between the pressing head 2 and the main column 5, which can allow emulsion in the main column 5 to flow to the pressing head 2 and prevent emulsion in the pressing head 2 from flowing to the main column 5; a second one-way valve device is provided between the plastic spring 6 and the inlet 11 of the body, which can allow emulsion to flow into the plastic spring 6 from the inlet 11 of the body and prevent the emulsion in the plastic spring 6 from flowing out of the inlet 11 of the body; the body 1, the threads 3, the pressing head 2, the main column 5, the suction tube 4, the plastic spring 6, the pull rod 7, the stopper 71, the lock cover 8, the first one-way valve device, and the second one-way valve device are respectively made of plastic material.

The all-plastic emulsion pump adopts a completely new structure, by arranging a side-sealed tubular plastic spring 6 under the main column 5, and connecting the main column 5 and the inlet 11 of the body via the plastic spring 6 to form a channel for the emulsion to flow from the inlet 11 of the body to the main column 5, the first one-way valve device is provided between the pressing head 2 and the main column 5, and the second one-way valve device is provided between the plastic spring 6 and the inlet 11 of the body so that one storage cavity for storing the emulsion is formed among the main column 5, the plastic spring 6, the first one-way valve device, and the second one-way valve device. When the pressing head 2 is pressed under the action of an external force, the plastic spring 6 is compressed and shortened, the volume of the storage cavity becomes smaller, and the internal pressure becomes larger, forming a pressure difference with the outside; since the first one-way valve device and the second one-way valve device are both in a one-way circulating structure, the emulsion flows from the storage cavity to the pressing head 2 via the first one-way valve device and flows out from the pressing head 2. When the external force is released, the main column 5 and the pressing head 2 are jacked up under the elastic force of the plastic spring 6. As the plastic spring 6 expands and becomes longer, the volume of the storage cavity becomes larger, and the internal pressure thereof becomes smaller, forming a pressure difference with the outside. The emulsion flows, via the suction tube 4, into the storage cavity from the inlet 11 of the body via the second one-way valve device to achieve the effect of pumping the emulsion. However, arranging a pull rod 7 inside the plastic spring 6, and a stopper 71 on the upper end of the pull rod 7, when the plastic spring 6 pops up, the plastic spring 6 and the main column 5 are pulled down by pressing the stopper 71 on the communication port 61, and the communication port 61 is blocked and sealed so that when the bottle is deformed under pressure, the emulsion in the plastic spring 6 can be prevented from entering the main column 5 through the communication port 61. Therefore, the emulsion in the main column 5 can be prevented from flowing out after flowing to the pressing head 2, and the sealing property is good. The stopper 71 has an inverted conical structure, middle and lower parts thereof can be pressed into the communication port 61 so that the sealing property and stability are better. When the pressing head 2 is pressed down, the communication port 61 moves downward as the main column 5 and the plastic spring 6 contract, and disengages from the stopper 71, and the emulsion flows from the plastic spring 6 into the main column 5 through at least a gap between the pull rod 7 and the side wall of the communication port 61.

With the above construction, all parts of the emulsion pump can be made of plastic material, which is easy to meet high environmental requirements, easy to recycle, and no need to use lubricating liquid.

The lock cover 8 is sleeved on the outer side of the main column 5. A waterproof sleeve 9 is provided between the lock cover 8 and the main column 5 for blocking a gap between the an upper end of the lock cover 8 and the main column 5. The waterproof sleeve 9 is made of plastic material. Since the lock cover 8 is fixed on the body and the main column 5 moves up and down relative to the lock cover 8, by arranging the waterproof sleeve 9, it is possible to prevent the external liquid and impurities from entering the body 1 from the gap between the lock cover 8 and the main column 5, and to prevent the contamination of the interior of the emulsion pump. The plastic spring 6 and the main column 5 are snap-connected and can prevent the two from being separated up and down, thereby facilitating the assembly and disassembly of the plastic spring 6 and the main column 5.

The upper end of the plastic spring 6 is provided with an annular fastening portion 62 inserted into the main column 5 from a lower port of the main column, an outer side surface of the fastening portion 62 is in a sealing connection with an inner side surface of the main column 5, and the communication port 61 is provided on the plastic spring 6 and is located inside the fastening portion 62. A second buckling ring 63 protrudes from an outer side of the fastening portion 62, and an inner wall of the main column 5 is provided with a second buckling groove 51 which is recessed and buckled with the second buckling ring 63, and during the assembly, the fastening portion 62 and the main column 5 are inserted into each other until the second buckling ring 63 is snap-connected with the second buckling groove 51.

The upper end of the plastic spring 6 is provided with an annular end surface 64 which is positioned outside the fastening portion 62 and can be fit to the lower end face of the main column 5 hermetically. When the main column 5 is pressed down, the lower end face of the main column 5 presses against the annular end surface 64 and forms a seal between the two end faces. As the pressing head 2 is pressed down, the internal pressure of the main column 5 becomes large. During the pressing down, the lower end face of the main column 5 presses on the annular end surface 64 and forms a seal between the two end faces, so that there is a better seal property between the main column 5 and the plastic spring 6. However, when the main column 5 is stationary and pops up, since the internal pressure of the main column 5 is small, the liquid in the main column 5 is prevented from flowing out from the joint between the main column 5 and the plastic spring 6 by the sealing connection between the outer side surface of the fastening portion 62 and the inner side surface of the main column 5.

The inner holes of the lower ends of the fastening portion 62 and the main column 5 are circular. The second buckling ring 63 and the second buckling groove 51 are correspondingly annular, and enable the main column 5 to rotate relative to the plastic spring 6 under the action of an external force. A guide structure for guiding an up and down movement of the main column 5 is arranged between the lock cover 8 and the main column 5, and when the main column 5 rotates relative to the lock cover 8, the guide structure is misaligned and prevents the up and down movement of the main column 5.

The guide structure includes a guiding groove 81 arranged on the lock cover 8, and the main column 5 is provided with a guiding column 53 for guiding up and down in cooperation with the guiding groove 81. One side of an upper end of the guiding groove 81 is provided with a locking groove 82 which is recessed and can be used for the guiding column 53 to rotate out of the guiding groove 81 and then snap in after the main column 5 pops up, and the groove bottom of the locking groove 82 is located below the guiding column 53 and limits the downward movement of the guiding column 53.

When the plastic spring 6 is in a pop-up state, the pressing head 2 and the main column 5 are rotated so that the main column 5 rotates relative to the lock cover 8. And the guiding column 53 rotates out of the guiding groove 81 and snaps in the locking groove 82 so that the main column 5 cannot move downwards. When the plastic spring 6 is in a pop-up state, since the plastic spring 6 is limited by the lock cover 8, and the pull rod 7 and the stopper 71 pull the plastic spring 6 and the main column 5 downwards, the main column 5 is limited from moving upwards so that the locking of the emulsion pump is realized. Of course, since the plastic spring 6 and the main column 5 are snap-connected, the main column 5 can be forcibly pulled out from the plastic spring 6 when the external force is large enough.

The first one-way valve device includes a first valve core 10, the main column 5 is provided therein with a main column outlet 52 in communication with the pressing head 2, the first valve core 10 includes a first outer ring 101 fixed between the pressing head 2 and the main column 5, an inner side of the first outer ring 101 is provided with a first inner core 102 isolated from the first outer ring 101 and covering the main column outlet 52 from the side of the pressing head 2, and the first outer ring 101 and the first inner core 102 are elastically connected via a first rib 103 and enable the first inner core 102 to float upwards when its bottom is pressed so as to open the main column outlet 52 with a simple structure.

The lower end of the pressing head 2 is provided with a first positioning groove 21 which is recessed and is used for positioning the first outer ring 101 after it snaps in; an annular boss 54 which projects to one side of the pressing head 2 and presses the first inner core 102 to one side of the pressing head 2 is provided on the outer side of the main column outlet 52 in the main column 5; the annular boss 54 is located on the lower inner side of the first inner core 102, and the main column outlet 52 is sealed by pressing the first inner core 102 on the annular boss 54. The annular boss 54 projects upwards and presses the first inner core 102 towards one side of the pressing head 2 so that the first inner core 102 and the annular boss 54 have an initial pre-pressure. Therefore, the sealing performance of the first one-way valve device is better when the main column 5 is in a stationary state and during the pop-up process.

The first outer ring 101, the first inner core 102, and the first rib 103 are integrally formed from an elastic-plastic material, preferably a rubber material, with a simple structure.

The inner wall of the main column 5 is provided with a recessed first buckling groove 55; the pressing head 2 is provided with a first buckling ring 22 which is snapped into the first buckling groove 55 and limits the pressing head 2 up and down; the inner side of the main column 5 is provided with an anti-rotation groove 56 along the circumferential direction; the pressing head 2 is provided with an anti-rotation strip 23 which can be snapped into the anti-rotation groove 56 to prevent the pressing head 2 from rotating relative to the main column 5.

Figure 2:
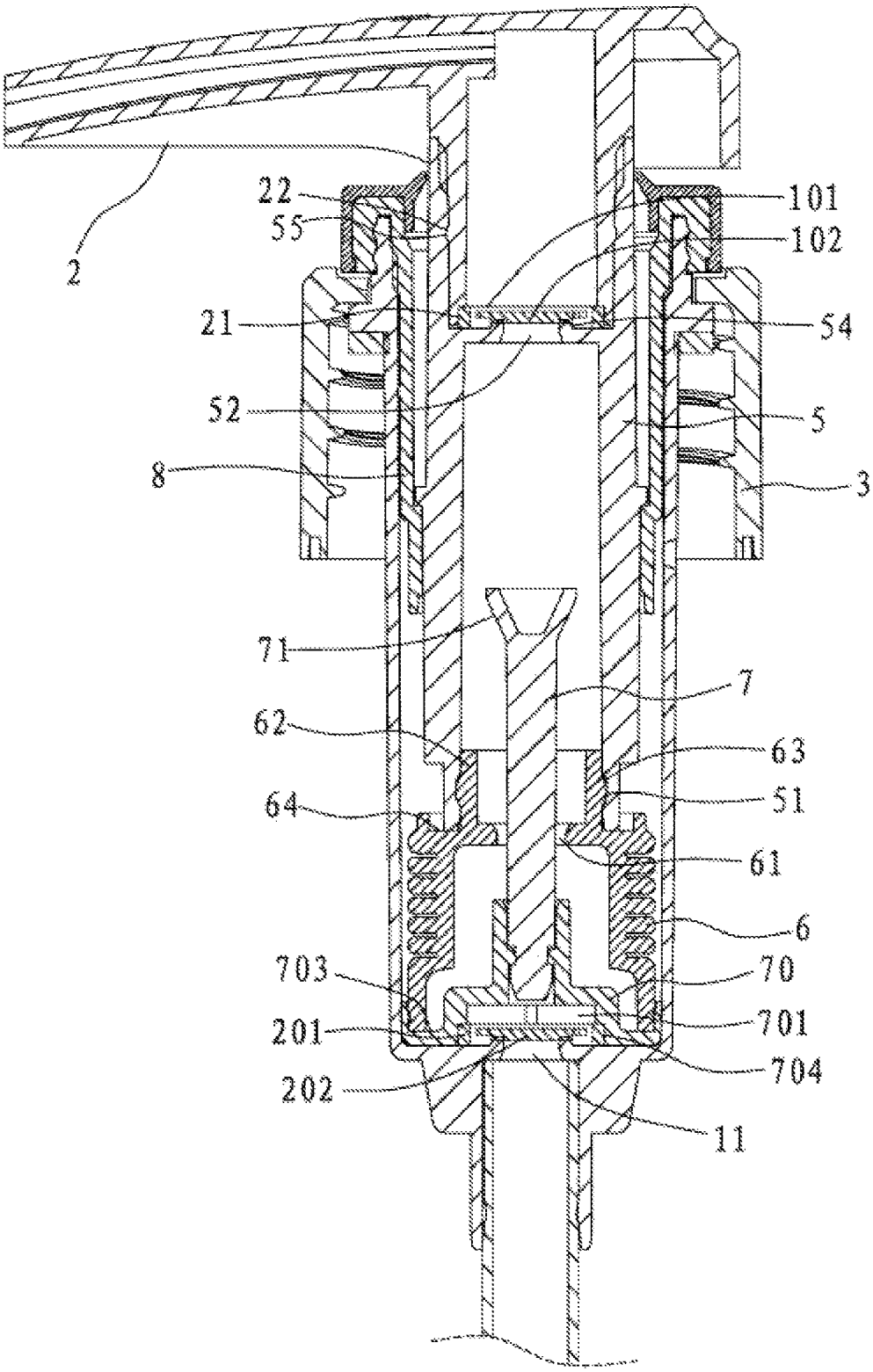
FIG. 2 is a sectional view of an all-plastic emulsion pump of the invention in a state when a pressing head thereof is pressed down.
Figure 3:
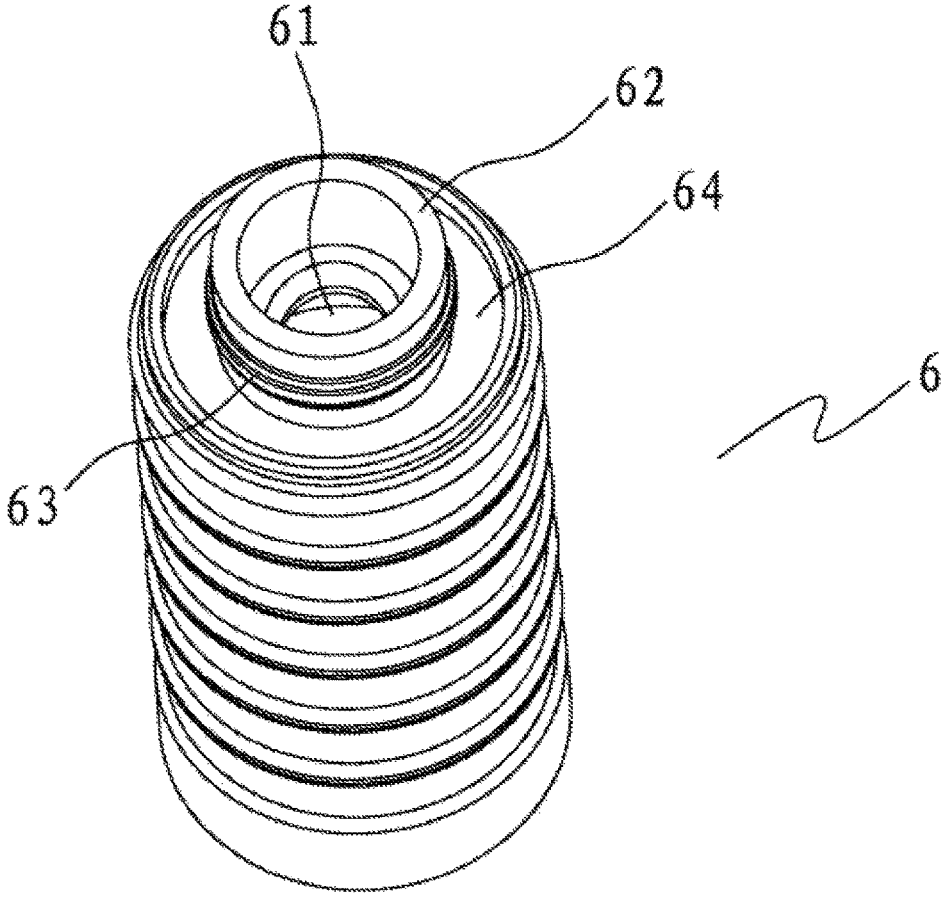
FIG. 3 is a schematic view showing a structure of a plastic spring.
Figure 4:
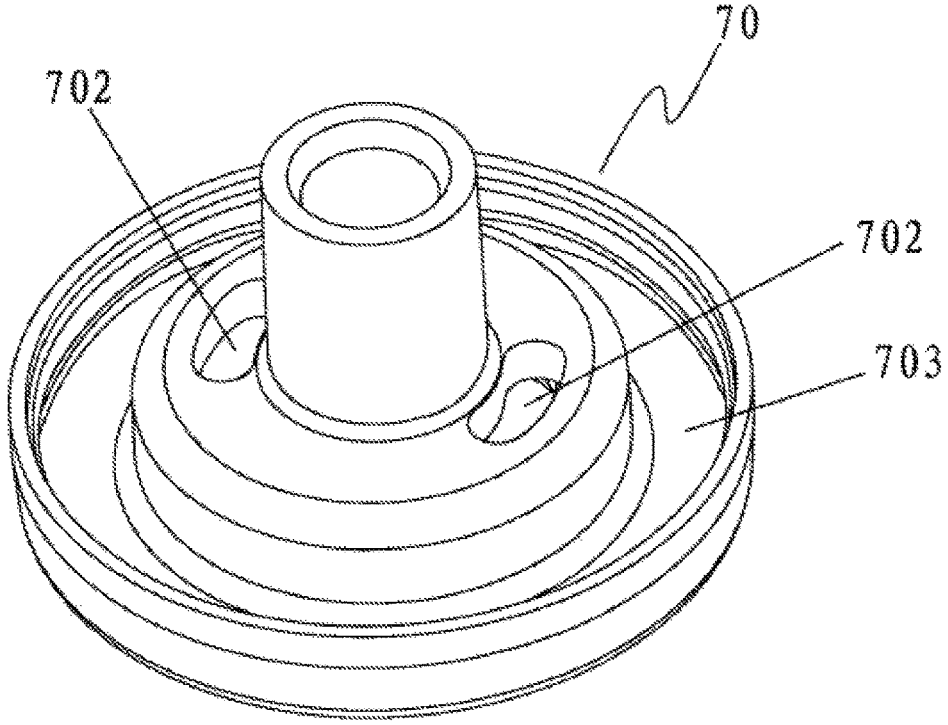
FIG. 4 is a schematic view showing the structure of a sealing seat.
Figure 5:
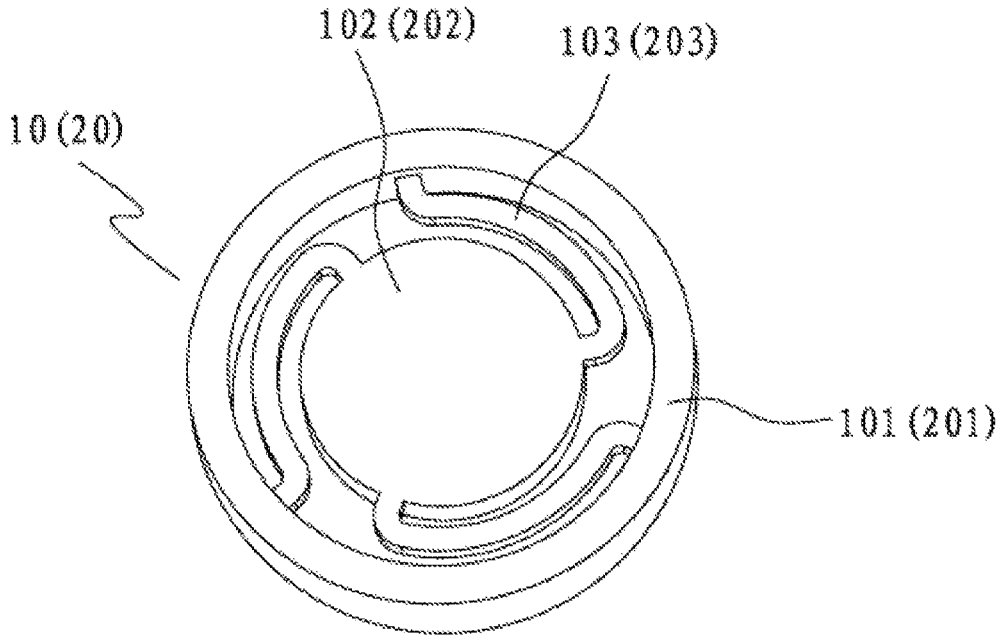
FIG. 5 is a schematic view showing the structure of a first valve core and a second valve core.
Figure 6:
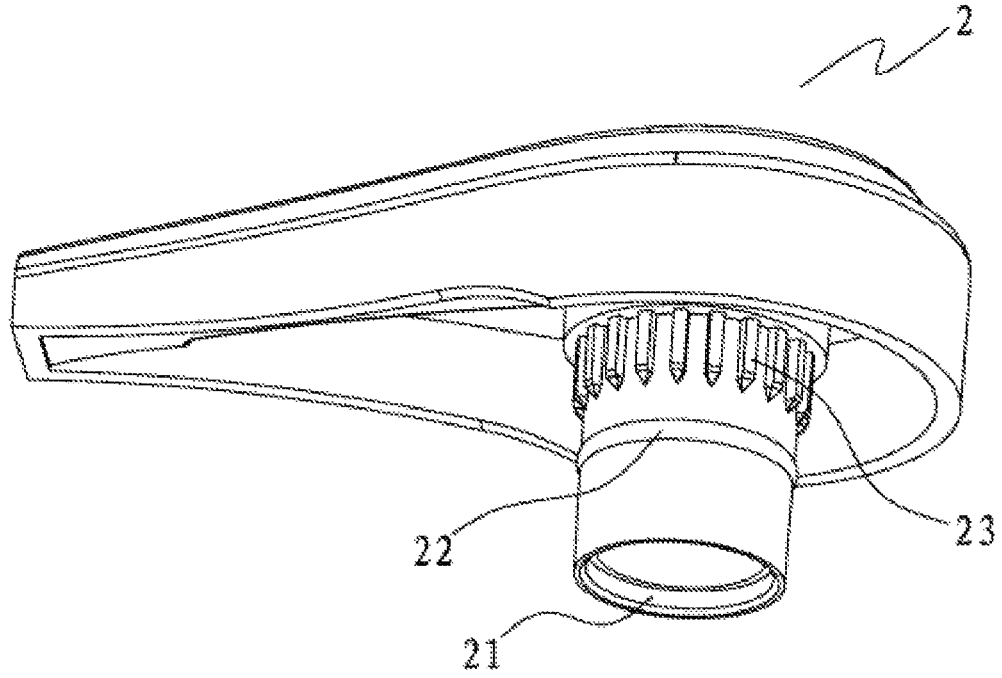
FIG. 6 is a schematic view showing the structure of a pressing head.
Figure 7:
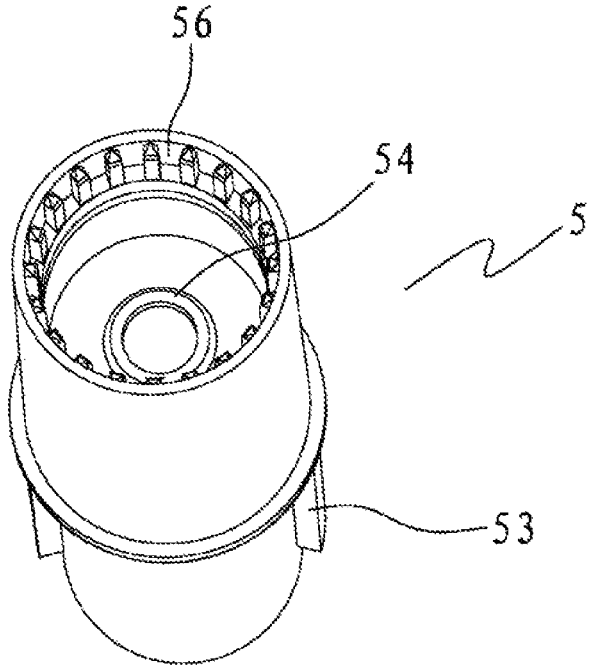
FIG. 7 is a schematic view showing the structure of a main column.
Figure 8:
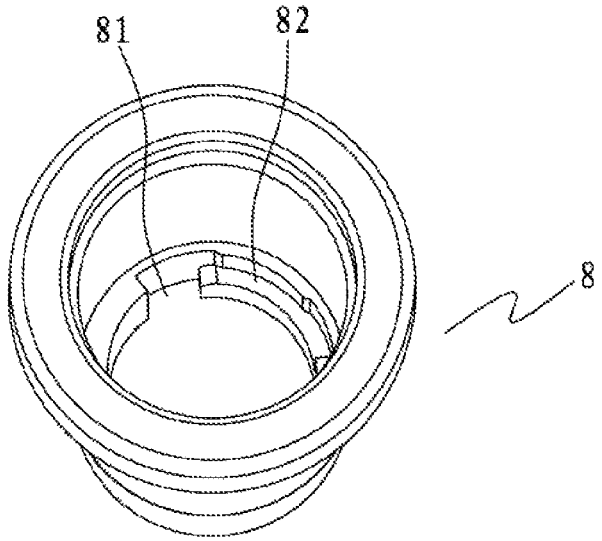
FIG. 8 is a schematic view showing the structure of a lock cover.

When the pressing head 2 and the main column 5 are assembled, the first valve core 10 is firstly placed in the first positioning groove 21 at the lower end of the pressing head 2; the anti-rotation strip 23 is opposite to the anti-rotation groove 56, and the pressing head 2 is inserted into the upper end of the main column 5 until the first buckling ring 22 is snap-connected with the first buckling groove 55; at this time, the first outer ring 101 is pressed between the pressing head 2 and the main column 5, and the first inner core 102 is pressed on the annular boss 54; as shown in FIG. 2, the structure is simple and the assembly is convenient.

A sealing seat 70 for sealing and connecting the plastic spring 6 and the body 1 is provided therebetween; the sealing seat 70 is made of plastic material; a lower end of the pull rod 7 is fixed on the sealing seat 70, a bottom of the sealing seat 70 is provided with a bottom cavity 701, the sealing seat 70 is provided with at least a through-hole 702 communicating the plastic spring 6 with the bottom cavity 701, the bottom cavity 701 is communicated with the inlet 11 of the body. By sealing the lower end of the plastic spring 6 with the sealing seat 70 and fixing the pull rod 7, the structure is simple.

The second one-way valve device includes a second valve core 20, the second valve core 20 is located in the bottom cavity 701, the second valve core 20 includes a second outer ring 201 fixed between the sealing seat 70 and the body 1, an inner side of the second outer ring 201 is provided with a second inner core 202 which is isolated from the second outer ring 201 and covering the inlet 11 of the body from one side of the bottom cavity 701, and the second outer ring 201 and the second inner core 202 are elastically connected via a second rib 203 and enable the second inner core 202 to float upwards when its bottom is pressed so as to open the inlet 11 of the body, with a simple structure.

The second outer ring 201, the second inner core 202, and the second rib 203 are integrally formed from an elastic-plastic material, preferably a rubber material, with a simple structure and convenient manufacturing.

The lock cover 8 is located above the plastic spring 6, and when the plastic spring 6 pops up, the lock cover 8 stops the plastic spring 6 from above and defines the maximum height of the plastic spring 6 popping up, the plastic spring 6 is in a compressed state when popping up and pressing against the lock cover 8; a lower end of the plastic spring 6 presses on the sealing seat 70 and presses the sealing seat 70 on the bottom of the inner cavity of the body 1; the sealing seat 70 is provided with a sealing groove 703 for the lower end of the plastic spring 6 to be inserted; the lower end face of the plastic spring 6 presses against the groove bottom of the sealing groove 703 and is sealingly fit with the groove bottom of the sealing groove 703; under the elastic pressure of the plastic spring 6, a bottom surface of the sealing seat 70 closely attaches with the bottom of the inner cavity of the body 1 and forms a seal with the bottom of the inner cavity of the body 1 at the bottom surface of the sealing seat 70. Since the plastic spring 6 is in different degrees of compressed state in the pop-up state, the pressed-down state, and during the pop-up and the pressed-down process, the sealing seat 70 can always be pressed on the bottom of the inner cavity of the body 1, the sealing seat 70 and the body 1 are always connected in a sealed manner, and the lower end face of the plastic spring 6 is always pressed on the groove bottom of the sealing groove 703 in a sealed connection.

Since the plastic spring 6 is pressed between the lock cover 8 and the sealing seat 70 in the pop-up state, the friction force to be overcome for the rotation of the plastic spring 6 and the sealing seat 70 is large. When the pressing head 2 and the main column 5 are rotated, the main column 5 can be rotated relative to the plastic spring 6, thereby preventing the rotation of the plastic spring 6 and the sealing seat 70.

Therefore, an independent sealing seat 70 and plastic spring 6 are used. After the plastic spring 6 is inserted into the sealing groove 703 of the sealing seat 70, the pull rod 7 is inserted from the plastic spring 6, the pull rod 7 is inserted into the sealing seat 70, and the plastic spring 6 is limited between the sealing seat 70 and the stopper 71 to form one integral body and is inserted into the body 1, wherein the side wall of the sealing seat 70 cooperates with the side wall of the inner cavity of the body 1, and the structure is simple and the assembly is convenient.

In addition, the bottom of the sealing seat 70 is provided with a second positioning groove 704 for positioning the second outer ring 201 after it snaps in. When the sealing seat 70 is loaded into the body 1, the second valve core 20 is placed in the second positioning groove 704, and the second valve core 20 can be fixed above the inlet 11 of the body 1 by being pressed by the elastic force of the plastic spring 6.

The plastic spring 6 is in a compressed state after popping up. On the one hand, it can stabilize the position of the pressing head 2 and the main column 5 after popping up; on the other hand after the plastic spring 6 pops up, it can make the pull rod 7 and the stopper 71 pull tightly at the communication port 61 to ensure the sealing; further, when the bottle is deformed under pressure and the pressure of the inner cavity of the plastic spring 6 increases, the rising up pressure of the plastic spring 6 is shared so as to prevent the pulling force of the pull rod 7 and the stopper 71 from being too large at the communication port 61.

The invention claimed is:

1. An all-plastic emulsion pump, comprising a body and a pressing head, wherein an upper end of the body is provided with threads, a lower end of the body is provided with a suction tube communicated with an inlet of the lower end of the body, the pressing head is connected to a main column inserted into the body, a plastic spring which can jack up the pressing head and the main column is provided in an inner cavity of the body, the plastic spring is located below the main column, the plastic spring is in a sealed connection with the main column, the plastic spring is a plastic spring tube with upper and lower ends open and side sealed, the upper end of the plastic spring is in communication with the main column, and the lower end of the plastic spring is in communication with the inlet of the body so that the plastic spring forms a channel for connecting the main column with the inlet of the body and for liquid to flow; at least a communication port for communicating the plastic spring and the main column up and down is provided between the two, the body is provided with a pull rod located inside the plastic spring, the pull rod corresponds up and down with the communication port and can penetrate out of the communication port when the plastic spring is pressed down, and there is a gap between the pull rod and side wall of the communication port; an upper end of the pull rod is provided with a stopper located above the communication port, and the stopper can press on the communication port from above when the plastic spring is pop-up to pull down the plastic spring and the main column, and seal the communication port; an upper opening of the body is provided with a lock cover which can limit the plastic spring in the body;

a first one-way valve device is provided between the pressing head and the main column, which can allow emulsion in the main column to flow to the pressing head and prevent emulsion in the pressing head from flowing to the main column; a second one-way valve device is provided between the plastic spring and the inlet of the body, which can allow emulsion to flow into the plastic spring from the inlet of the body and prevent the emulsion in the plastic spring from flowing out of the inlet of the body; the body, the threads, the pressing head, the main column, the suction tube, the plastic spring, the pull rod, the stopper, the lock cover, the first one-way valve device, and the second one-way valve device are respectively made of plastic material;

wherein a sealing seat for sealing and connecting the plastic spring and the body is provided therebetween; a lower end of the pull rod is fixed on the sealing seat a bottom of the sealing seat is provided with a bottom cavity; the sealing seat is provided with at least a through-hole communicating the plastic spring with the bottom cavity, the bottom cavity is communicated with the inlet of the body.

2. The all-plastic emulsion pump according to claim 1, wherein the lock cover is sleeved outside the main column, a waterproof sleeve for blocking the gap between an upper end of the lock cover and the main column is provided between the lock cover and the main column.

3. The all-plastic emulsion pump according to claim 1, wherein the plastic spring and the main column are snap-connected and can prevent the two from being separated up and down.

4. The all-plastic emulsion pump according to claim 3, wherein the upper end of the plastic spring is provided with an annular fastening portion inserted into the main column from a lower port of the main column, an outer side surface of the fastening portion is in a sealing connection with an inner side surface of the main column, and the communication port is provided on the plastic spring and is located inside of the fastening portion, a second buckling ring protrudes from an outer side of the fastening portion, an inner wall of the main column is provided with a second buckling groove which is recessed and buckled with the second buckling ring.

5. The all-plastic emulsion pump according to claim 4, wherein the upper end of the plastic spring is provided with an annular end surface which is positioned outside the fastening portion and can be fit to the lower end face of the main column hermetically, when the main column is pressed down, the lower end face of the main column presses against the annular end surface and forms a seal between the two end faces.

6. The all-plastic emulsion pump according to claim 4, wherein inner holes of the lower ends of the fastening portion and the main column are circular, the second buckling ring and the second buckling groove are correspondingly annular, and enable the main column to rotate relative to the plastic spring under the action of an external force, a guide structure for guiding an up and down movement of the main column is arranged between the lock cover and the main column, and when the main column rotates relative to the lock cover, the guide structure is misaligned and prevents the up and down movement of the main column.

7. The all-plastic emulsion pump according to claim 1, wherein the first one-way valve device includes a first valve core, the main column is provided therein with a main column outlet in communication with the pressing head, the first valve core includes a first outer ring fixed between the pressing and the main column, an inner side of the first outer ring is provided with a first inner core isolated from the first outer ring and covering the main column outlet from the side of the pressing head, and the first outer ring and the first inner core are elastically connected via a first rib and enable the first inner core to float upwards when its bottom is pressed so as to open the main column outlet.

8. The all-plastic emulsion pump according to claim 1, wherein the second one-way valve device includes a second valve core, the second valve core is located in the bottom cavity, the second valve core includes a second outer ring fixed between the sealing seat and the body, an inner side of the second outer ring is provided with a second inner core which is isolated from the second outer ring and covering the inlet of the body from one side of the bottom cavity, and the second outer ring and the second inner core are elastically connected via a second rib and enable the second inner core to float upwards when its bottom is pressed so as to open the inlet of the body.

9. The all-plastic emulsion pump according to claim 1, wherein the lock cover is located above the plastic spring, and when the plastic spring pops up, lock cover stops the plastic spring from above and defines the maximum height of the plastic spring popping up, the plastic spring is in a compressed state when popping up and pressing against the lock cover; a lower end of the plastic spring presses on the sealing seat and presses the sealing seat against a bottom of the inner cavity of the body; the sealing seat is provided with a sealing groove for the lower end of the plastic spring to be inserted; the lower end face of the plastic spring presses against the groove bottom of the sealing groove and is sealingly fit with the groove bottom of the sealing groove; under the elastic pressure of the plastic spring, a bottom surface of the sealing seat closely attaches with the bottom of the inner cavity of the body and forms a seal with the bottom of the inner cavity of the body at the bottom surface of the sealing seat.

* * * * *